US005709635A

United States Patent [19]

Denison

[11] Patent Number: 5,709,635

[45] Date of Patent: Jan. 20, 1998

[54] EXERCISE HAND WEIGHTS WITH SELF-DEFENSE SPRAY CONTAINER

[75] Inventor: Steven W. Denison, Spokane, Wash.

[73] Assignee: Hyak Corporation, Mercer Island, Wash.

[21] Appl. No.: 541,116

[22] Filed: Oct. 11, 1995

Related U.S. Application Data

[63] Continuation-in-part of Ser. No. 261,190, Jun. 13, 1994, abandoned.

[51] Int. Cl.[6] ..... A63B 21/072

[52] U.S. Cl. ..... 482/108; 482/106; 222/175

[58] Field of Search ..... 482/50, 74, 92, 482/106, 108, 109; 273/84 R, 84 ES; 42/1.08, 1.13, 1.16; 222/175

[56] References Cited

U.S. PATENT DOCUMENTS

| | | | |
|---|---|---|---|
| 3,235,992 | 2/1966 | Busillo . | |
| 3,432,077 | 3/1969 | Voll . | |
| 3,756,467 | 9/1973 | Anketell . | |
| 4,058,237 | 11/1977 | Luke . | |
| 4,135,645 | 1/1979 | Kimmell . | |
| 4,223,804 | 9/1980 | Morris et al. . | |
| 4,449,474 | 5/1984 | Mariol . | |
| 4,550,861 | 11/1985 | Fay et al. . | |
| 4,627,618 | 12/1986 | Schwartz . | |
| 4,638,994 | 1/1987 | Gogarty | 482/108 |
| 4,703,927 | 11/1987 | Hanzlik . | |
| 4,728,037 | 3/1988 | Mainhardt . | |
| 4,778,173 | 10/1988 | Joutras | 482/108 |
| 5,088,624 | 2/1992 | Hackett et al. . | |
| 5,135,454 | 8/1992 | Yeh . | |
| 5,135,455 | 8/1992 | King et al. | 482/108 |
| 5,235,997 | 8/1993 | Washington et al. . | |
| 5,242,349 | 9/1993 | Reiff et al. . | |
| 5,286,244 | 2/1994 | Wright et al. . | |
| 5,318,492 | 6/1994 | Quinn . | |
| 5,332,119 | 7/1994 | Davis | 482/108 |
| 5,405,134 | 4/1995 | Wolfram | 222/175 |
| 5,531,359 | 7/1996 | Winner | 42/1.08 |
| 5,556,003 | 9/1996 | Johnson et al. | 482/108 |

FOREIGN PATENT DOCUMENTS

| | | | |
|---|---|---|---|
| 1015338 | 9/1952 | France | 482/108 |

*Primary Examiner*—Jeanne M. Clark
*Attorney, Agent, or Firm*—Keith S. Bergman

[57] ABSTRACT

Similar paired exercise hand weights provide one hand weight of the pair with a self-defense spray dispensing container carried therein. Each hand weight provides an elongate tubular body having enlarged end portions and defining an internal channel to optionally contain a self-defense spray container and weights. Annular bands encircling the upper and lower portions of the cylindrical body fasten the end portions of an elastic fastening band that stretches over the body for positioning over the back of a user's hand to aid positional maintenance of the weight on the hand. A resilient covering about the cylindrical body provides an improved gripping surface and greater comfort for gripping. Each hand weight has at least one removable end cap for access to the body channel and the hand weight that embodies a self-defense spray container has a removable end cap that defines a passageway for the operative mechanism of a defense spray container and an orifice for exit of self-defense spray.

7 Claims, 3 Drawing Sheets

EXERCISE HAND WEIGHTS WITH SELF-DEFENSE SPRAY CONTAINER

RELATED APPLICATIONS

This is a continuation-in-part of a prior application filed Jun. 13, 1994 under Ser. No. 08/261,190 and now abandoned.

BACKGROUND OF INVENTION

1. Field of Invention

The instant invention relates to a pair of similar hand carried exercise weights, of which at least one of a pair carries a self-defense spray dispenser.

2. Background and Description of Prior Art

Running, jogging and walking have become increasingly popular forms of exercise but these activities primarily exercise the groups of lower body muscles and do little to exercise most upper body muscle groups. Because most exercisers desire to exercise all body muscle groups, it has become common for exercisers to carry hand weights that may be moved during the running, jogging or walking activities to further exercise upper body muscles. Various weights for such purpose have heretofore become known and the instant invention provides new and novel members of this class of device.

Walkers, joggers and runners, hereinafter generically referred to as exercisers, in accomplishing their activities generally move through substantial distances, commonly in outdoor environments, that expose them to potential physical attacks by both animals and humans to make such exercisers potential victims of these activities. The potentiality of such happenings has continuously increased until in the present society the problem is one of substantial concern. Various defense sprays containerized under pressure for dispersement, such as essential oils of peppers, tear gas, other lacrimal agents, stunning agents, blistering agents and the like, have become popular in defense devices to combat this problem. The instant invention combines such a defense spray with an exercise hand weight to allow use of the combined device by exercisers without disrupting the normal functions of either member.

Most known defense spray containers have been designed for carriage in some concealed or semi-concealed fashion, as knowledge of the presence of the device and its location by a potential attacker may lessen the utility of the device. The containers generally have been adapted for concealment in a user's clothing or sometimes in or about a secondary object carried by the user such as a cane, attache case, purse, flashlight or the like. Such secondary objects generally are not particularly useful to exercisers who usually are scantily clothed with garments that have little or no potentiality for concealment of even small items. Exercisers similarly, by reason of their activities, cannot practically carry or be burdened by secondary objects in which self-defense spray containers traditionally have been contained. The instant invention solves this problem by providing a semi-concealed defense spray container within a hand weight that is a common part of the running and jogging exercise program.

Pressurized containers of defense spray material must be readily available and easily operable for dispersement of their contents to be effective, but yet the devices pose a danger to their users or to unintended targets if they are accidentally discharged. The solution of both problems simultaneously requires some type of compromise as means for preventing accidental discharge of the defense sprays normally make more difficult the intentional discharge of the product when desired. The instant device contains a defense spray in a chamber in the end portion of an elongate hand weight, with channels defined therein for spray dispersement and operating mechanism access, while yet providing a structure about part of the operating mechanism that partially contains and protects it in a fashion that substantially prevents accidental discharge. By reason of the normal positioning of the hand weights in use, any accidental discharge that might occur generally would also be at a distance and away from the face of a user, so that even if accidental discharge occurs it would do minimal damage or cause minimal discomfort to a user.

The instant weight also provides a removable cover cap that may be placed over the end portion of the weight carrying the self-defense spray container and dispersement mechanism to prevent any access to that mechanism during storage or other periods when the defense spray would not be used.

Containers for many pressurized defense sprays have become reasonably standardized in both function and configuration. These containers generally provide a cylindrical reservoir having an upstanding dispersement neck with a valve type triggering device in its upper portion that moves vertically to allow containerized material to exit from a nozzle extending from the triggering device perpendicularly to the neck. The instant hand weight allows use of a substantial number of such defense spray containers that are available in the present day marketplace. My weights also may be modified to accommodate other containers having particularized configurations without changing or modifying the overall hand weight features.

Most known hand weights for exercisers have a generally elongate, cylindrical configuration with at least the medial portion having a diameter to allow grasping by a hand of a user. If such prior weights are used for extended periods, the fingers of a hand holding them often become tired, and it is therefore desirable that such weights have some means to aid positional maintenance in or about the hand of a user without requiring continuous grasping action by the user. Various rigid handle-like structures have become known for this purpose, but have not proven entirely satisfactory as they often cause stresses or strains in the hands that are as undesirable as those created by grasping an elongate weight body, and they often require particular positioning or holding of the hand weights. The instant invention in contradistinction provides a flexible elastomeric band extending between the end portions and over the medial body portion of the weight so that the medial body portion may be grasped in normal fashion with the elastomeric band extending over the back of a user's hand. By reason of its elastic bias, the band will tend to maintain positioning of the weight upon a hand, but yet allow ready placement or removal. The instant weight also provides a peripheral covering about its medial body portion that is resiliently deformable to provide a better gripping surface and an enlarged cushion for grasping by a hand of a user to alleviate some grasping strain.

Normally exercise hand weights are used in pairs so that one weight may be carried in each hand but, it generally is not necessary that both weights contain a self-defense spray unit. The instant invention in keeping with the tradition of prior hand weights provides two weights of generally similar configuration, mass and mass distribution so that they feel the same, while yet having means for containment of a self-defense spray container in one but not the other.

My invention resides not in any one of these features individually, but rather in the synergistic combination of all of the structures of my hand weights that produce the functions necessarily flowing from that structure as herein specified and claimed.

SUMMARY OF INVENTION

My invention provides a pair of similar hand weights for exercisers, each defining an elongate medial body carrying similar end caps at least one of which is removable. The body defines an internal chamber and its outer periphery is covered by a layer of resilient material. An elastomeric band extends over the body between the end caps to aid in maintaining the weight on a user's hand. A first species of hand weight has one removable end cap to allow access to the medial body channel and one fixed end cap. The removable end cap defines cavities to contain the operating mechanism and ejection nozzle of the spray container and allow access thereto for operation and spray dispersement. In this species a weight is carried in the inner end portion of the medial body channel and positionally maintained by a sleeve that is releasably carried in the open end portion of the channel. The sleeve defines an internal chamber to carry a self-defense spray container having triggering mechanism and a spray nozzle projecting axially outwardly from the sleeve and from the medial body channel orifice.

A second species of hand weight has removable end caps at each end of the body. A first end cap carries a weight with a portion extending therefrom and inwardly a spaced distance into the first end of the medial body channel. A self-defense spray container is carried in the second end of the medial body channel and covered by a second end cap that defines cavities to contain and allow access to triggering mechanism and a spray nozzle.

Either species of weight, if not carrying a self-defense spray device, may have the end cap that normally would cover that mechanism replaced with an end cap that does not define any orifices. A cover cap may be provided to releasably cover the end cap covering the spray mechanism for storage or during other non-use periods.

In providing such hand weights it is:

A principal object to create a pair of similar exercise hand weights for walkers, joggers or runners, at least one of the pair carrying a container of pressurized defense spray material for personal protection.

A further object is to provide such hand weights that have an elongate medial body with similar diametrically larger end caps, a resilient material covering the periphery of the body, and a flexible elastomeric strap communicating over the body and between the end caps to aid support and positional maintenance of the weight on the hand of a user.

A further object is to provide such hand weights that define an internal channel in which weights may be carried to provide a pair of hand weights that have similar mass and mass distribution.

A still further object is to provide such hand weights that have a releasably positionable cover cap to cover the operative mechanism of a self-defense spray container to protect and conceal that mechanism and prevent accidental discharge of the spray.

A still further object is to provide a species of weight adapted for simple and easy manufacture that has removable end caps at each end of the body with the cap at the end distal from the defense spray container carrying a weight that extends into the body channel.

A still further object is to provide such weights that are of new and novel design, of rugged and durable nature, of simple and economic manufacture and otherwise well suited for the uses and purposes for which they are intended.

Other and further objects of my invention will appear from the following specification and accompanying drawings which form a part hereof. In carrying out the objects of my invention, however, it is to be remembered that its accidental features are susceptible of change in design and structural arrangement, with only one preferred and practical embodiment of the best known modes being described as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 2:
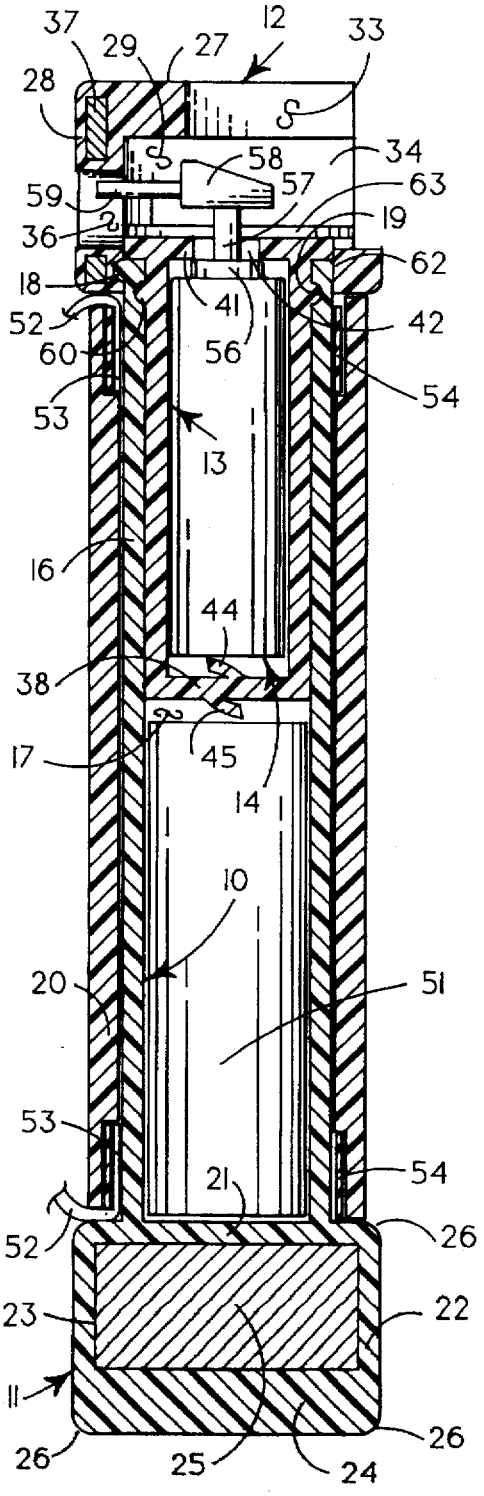
FIG. 2 is a medial, vertical cross-sectional view through the weight of FIG. 1, taken on the line 2—2 thereon in the direction indicated by the arrows.

The first species of my hand weights illustrated in FIGS. 1–8 generally provides elongate body 10 structurally carrying fixed end cap 11 and releasably carrying removable end cap 12 with fastening strap 15 extending over the elongate body between the end caps. The body defines an internal channel carrying sleeve 13 which carries defense spray container 14.

Body 10 comprises elongate body cylinder 16 defining medial body channel 17. The upper first end portion of the body 10 defines annular protuberance 18 extending radially outward from the outer body surface spacedly below the orifice of the body channel, to releasably interconnect removable end cap 12. The inner surface of the body cylinder that defines channel 17 also defines annular groove 19 spacedly below protuberance 18 to aid in fastening a sleeve in channel 17. The lower second end portion of cylinder 16 structurally interconnects fixed end cap 11 which closes the lower end of channel 17.

The outer surface of body cylinder 16 carries in immediate adjacency tubular covering 20 formed of a porous, resiliently deformable material to provide a larger and better gripping surface of a cushioned nature. The covering 20 has a length slightly less than that of cylinder 16 to allow positioning of the removable end cap 12 on the cylinder and defines notches, or is sufficiently deformable, to allow passage of fastening strap 15 between the cover ends and the adjacent end caps.

Fixed end cap 11 is a peripherally defined cylindrical structure having inner end 21 supporting perpendicular axially outwardly extending cylinder wall 22 to define internal chamber 23. The inner end 21 is of a diametrical size larger than the outer diameter of tubular cover 20 of the body and is structurally joined to the lower or second end portion of body 10 to cover the lower orifice of channel 17 defined therein. Outer end or bottom 24 defines the opposed surface of chamber 23, which carries cylindrical weight 25 to provide additional mass and appropriate mass distribution for the weight. Normally, weight 25 will be formed of some reasonably dense material such as iron or lead. The outer edge 26 of outer end 24 preferably is rounded to lessen the potentiality of damage to a user or external objects.

Removable end cap 12, of the same general external configuration as fixed end cap 11, is formed with outer end or top 27 structurally interconnecting perpendicularly depending cylindrical wall 28 to define internal cavity The thickness or radial dimension of cylindrical wall 28 is such that the internal cavity 29 is incrementally larger than the external diameter of body cylinder 16. The internal surface of cylindrical wall 28 defines annular fastening groove 30 spacedly axially inwardly of its lower inner surface to receive annular fastening protuberance 18 of the body cylinder in a releasably fastenable fashion. To prevent rotation of the cap 12 relative to body cylinder 10 the annular fastening protuberance 18 defines one or more notches 61 to receive interfitting dogs 62 defined in fastening groove 30. Annular radially inwardly extending ridge 63 is provided immediately inwardly from fastening groove 30 to prevent the fastening protuberance 18 from entering the end cap cavity 29 beyond the ridge 63. To assure sufficient resilience in the upper portion of body cylinder 16 to allow fastening of the removable end cap 12 thereon, plural axially parallel slots 31 are defined to extend inwardly a spaced distance from the upper end portion of the body cylinder.

Both fixed and removable end caps 11, 12 of a pair of weights of my invention have the same essential structure described and differ only in finer detail. The end cap 12 for use with a defense spray apparatus differs from that of cap **12*a*** that is used without an associated defense spray apparatus but both fit upon the same upper body cylinder end.

Figure 3:
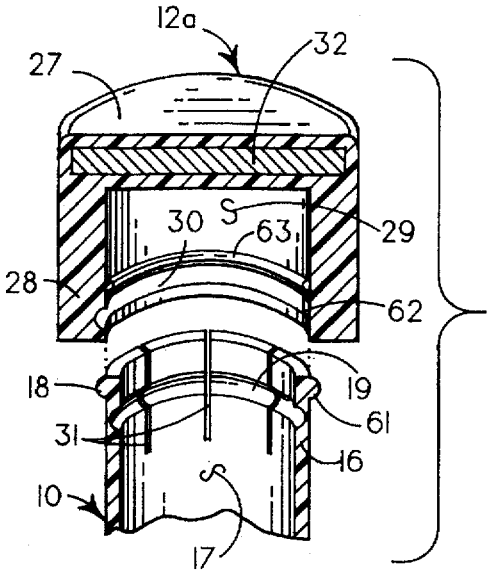
FIG. 3 is a partial, expanded isometric cross-sectional view of the upper portion of the body of a hand weight and an adjacent removable end cap that does not define chambers for the operative mechanism of a defense spray container.
Figure 5:
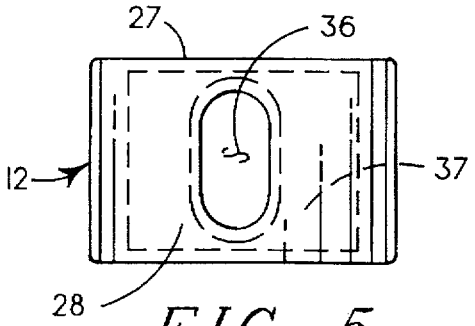
FIG. 5 is an orthographic front view of the end cap of FIG. 1, showing the weight carried in the cap in dashed outline.

The removable end cap **12*a* is shown in diametrical cross-section in FIG. 3. This cap provides a continuous top 27 that in this instance contains disk-like weight 32** formed of dense material such as a heavier metal to provide the overall mass desired for a hand weight and somewhat symmetrical weight distribution.

The removable end cap 12 for use with a defense spray apparatus is shown in FIGS. 1, 2, 4 and 5. This cap defines U-shaped thumb slot 33 defined in top 27 by lateral legs 34 and interconnecting inner arcuate portion 35 to extend vertically through the cap top 27 and the cylindrical wall 28 to its vertically lower portion. The portion of the cap 12 diametrically opposed to the vertically medial portion of the thumb slot defines vertically elongate nozzle hole 36 communicating from internal chamber 29 through the side wall 28 to carry a defense spray container nozzle and allow vertical motion of the nozzle for operation. A vertically oriented weight 37 may be carried in the side wall 28 of the cap to provide appropriate mass and mass distribution for the overall hand weight. Generally the portion of the cap top 27 that has not been removed is not sufficient in size to contain such weight, as it does in the cap **12*a*. If the weight 37 would extend into the nozzle slot 36 defined in the cap wall 28**, an appropriate orifice must be created in the weight to allow it to be completely encapsulated in the structure of the cap wall and not to block the nozzle orifice.

Sleeve 13 is a cylindrical structure configurationally similar to and incrementally smaller than body channel 17 so that it may be slidably carried therein. The sleeve is defined by bottom 38 structurally carrying cylindrical side wall 39 which in turn in its uppermost portion defines external radially extending annular rim 40 and internal inwardly extending segmental rims 41. The external rim 40 has an outer diameter incrementally less than the diameter of chamber 29 of the removable end cap 12, but greater than the internal diameter of body cylinder 16 so that the rim is maintained immediately above the top of body cylinder 16 when the body cylinder is carried in medial body channel 17. The internal inwardly extending rims 41 are formed by two diametrically opposed segments of the circle defining internal chamber 42 of the sleeve. These segments are so dimensioned as to maintain the upper neck portion of a defense spray container therebelow and prevent that container from passing axially outwardly of chamber 42 defined in the sleeve. The upper portion of the outer surface of the sleeve spacedly below rim 40 defines annular protuberance 60 to fit within groove 19 defined by the body to releasably maintain the sleeve in the upper portion of body channel 17.

The medial portion of side wall 39 of the sleeve 13, on a diameter perpendicular to the cords of the segments of rim 41, is removed to define orifice 43 through which a defense spray container may be inserted, upper end first, for containment within chamber 42. Bottom 38 in its medial portion defines upwardly projecting, resiliently deformable tab 44 to bias a defense spray container to an upper position in chamber 42 and downwardly projecting, resiliently deformable tab 45 to bias a weight in channel 17 of the body cylinder to a downward position.

A cylindrical weight 51 may be carried in the lower portion of body channel 17 adjacent fixed end cap 11. If such a weight is used, preferably its diameter is only incrementally smaller than the diameter of channel 17 and it has a length such that it will be biased against the inner surface of inner end 21 of the lower end cap 11 by downwardly projecting tab 45 of the sleeve 13 when the sleeve is in position in the upper end portion of channel 17.

Figure 1:
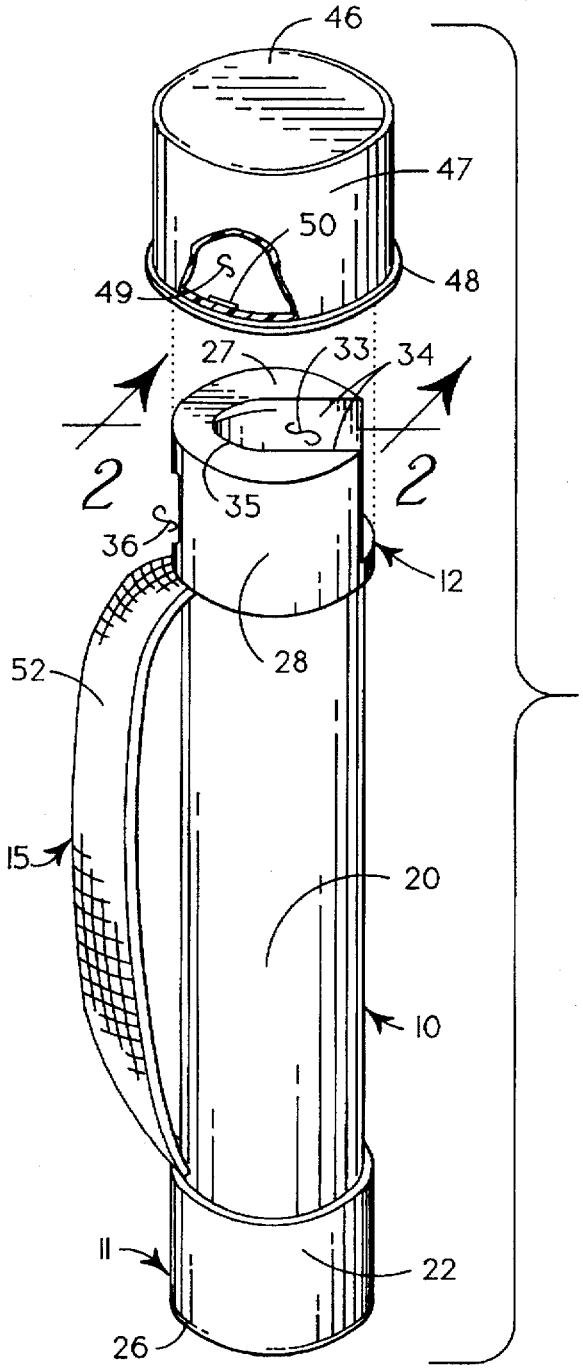
FIG. 1 is an expanded, partially cut-away, isometric view of one of the hand weights of a first species that contains a self-defense spray, with the cover cap removed to show various parts, their configuration and relationship.
Figure 4:
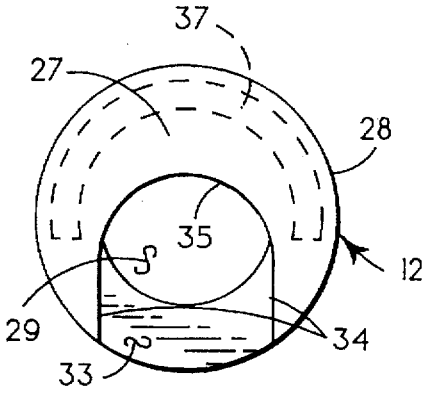
FIG. 4 is an orthographic top view of the end cap of FIG. 1, showing a contained weight in dashed outline.

A cover cap seen in FIG. 1 is provided to cover removable end cap 12 to protect the operative mechanism of a defense spray container carried therein and cover the orifices providing access to that mechanism to prevent accidental discharge. The cover cap is a peripherally defined structure formed by top 46 structurally interconnecting perpendicular cylindrical side wall 47 which terminates in lower rim 48 to define internal cavity 49 to contain and cover the removable end cap 12. The radially inner surface of lower rim 48 defines spaced, inwardly projecting, resilient fastening dogs 50, and the cover cap is so sized that when end cap 12 is covered the fastening dogs 50 will releasably fasten the cover cap by extending on the undersurface of the peripheral rim of the end cap. When not used as a cover for the upper dispersement end cap 12 of my weight, the cover cap may be stored on the lower end cap 11 and positionally maintained in the same fashion.

The dimensioning and configuration of my hand weights are not essential, so long as the various elements comprising them relate to each other as specified and described. Preferably, the overall length of the hand weight when assembled will be approximately seven and one-half inches, and the external diameter of the medial body will be approximately one and three-quarter inches. Preferably the overall mass of each weight will be approximately one pound and additional weight may be added to increase that total mass to approximately two pounds. The body cylinder, end caps, cover cap and sleeve preferably are formed from one of the semi-rigid polymeric or resinous plastics, and the weights preferably are formed from metal to provide appropriate mass. The tubular covering about the body cylinder is preferably formed of resiliently deformable foamed polymeric material.

Fastening strap 15 provides elongate elastomeric band 52 extending from fastenable engagement with body cylinder 16 between the end caps 11 and 12. The end portions 53 of the fastening strap extend a spaced distance along the outer surface of body cylinder 16 where they are fastened by annular bands 54 extending thereover and about the body cylinder. The fastening bands 54 are fastened on the body cylinder and they in turn fasten the end portions 53 of the fastening strap 52 by adhering the adjacent surfaces of the joined elements. The fastening strap extends over the covering 20 and has a length such that, in relaxed condition, it extends substantially adjacent to the outer surface of the covering 20. The elasticity of the fastening strap should be such as to allow it to extend in length sufficiently to pass over the back of the hand of a user holding a weight about its medial body portion and maintain that hand positioning with some elastic tension. Preferably the fastening strap is formed from woven fibers embodying elastomeric materials of a fibrous nature to provide appropriate elasticity in the direction of the longer dimension of the strap.

Figure 8:
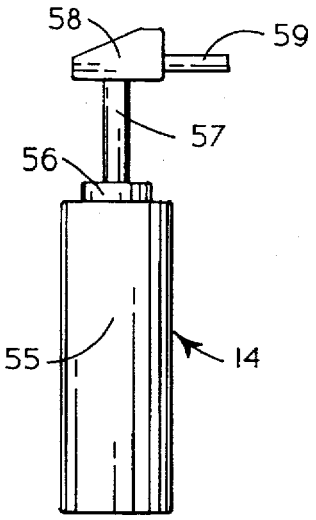
FIG. 8 is an orthographic elevational view of a typical defense spray container that may be used in the hand weight of FIG. 1.
Figure 7:
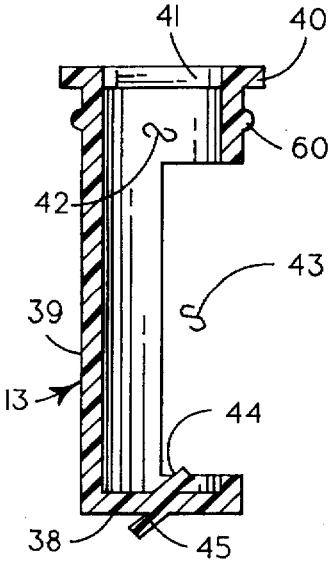
FIG. 7 is a medial, vertical cross-sectional view through the sleeve of FIG. 6, taken on the line 7—7 thereon in the direction indicated by the arrows.
Figure 6:
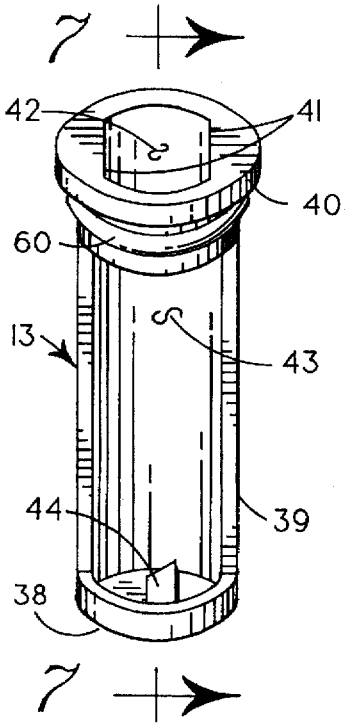
FIG. 6 is an isometric surface view of the sleeve used to carry a defense spray container in the first species of FIG. 1.

A typical pressurized defense spray container 14 is illustrated in FIG. 8, where it is seen to provide cylindrical container 55 having neck 56 and upwardly extending dispersement channel 57 communicating with trigger 58 and horizontally oriented dispersement nozzle 59. The container is operated by moving trigger 58 generally toward container 55 to disperse the pressurized material in the container through nozzle 59 in a spray fashion.

A second species of my hand weight illustrated in FIGS. 9–13 provides generally elongate body 100 releasably carrying lower end cap 101 and upper end cap 102 covering spray container 103.

Body 100 provides peripherally defined circular body cylinder 104 defining medial body channel 105 with septum 106 dividing that channel into upper and lower portions. The upper end portion of the body defines annular radially outwardly extending rim 107, which in turn defines annular fastening protuberance 108 on its peripheral cylindrical surface to fasten upper cap 102 thereon. The inner surface of the upper portion of body 104 defines annular spray container groove 109 to allow passage and positional maintenance of a self-defense spray container in the upper portion of body channel 105. The outer surface of body 104 spacedly below rim 107 preferably defines annular protruding rim 110 to aid positional maintenance of a strap fastening band on the body.

The lower portion of body cylinder 104 defines annular lower cap fastening groove 111 extending radially inwardly from the body periphery. Annular protruding strap fastening band rim 112 is defined on the outer surface of body cylinder 104 immediately above the fastening groove 111 and lower cap fastening rim 113 is defined in the outer surface of the lower body portion defining the lower cap fastening groove 112.

The size, configuration and construction of the body 100 are similar to the same attributes of the body of the first species of my hand weight. This second species, however, is somewhat better configured for economical manufacture by molding processes than is the first species.

The body 104 carries elastomeric hand strap 138 extending thereover between the two end caps. In the instance illustrated, one end of the hand strap is carried beneath upper fastening ring 139 and the other end beneath lower fastening ring 140. Each of the fastening rings 139 and 140 have an internal diameter incrementally larger than the external diameter of body cylinder 104 so that they may be carried thereon, with the upper ring 139 carried above strap fastening rim 110 and the lower ring 140 carried below lower strap fastening rim 112. The fastening rings have sufficient resilience that by appropriate manual manipulation they may be moved over either of the fastening rims 110, 112 for placement. The external circumferential surface of the cylindrical body 104 carries tubular cover 141 formed of resiliently deformable material similar to the corresponding cover 20 of the first species.

Lower cap 101 is a peripherally defined circular cylindrical structure formed by circumferential vertical skirt 114 carrying bottom 115 in its lower portion and annular top 116 in its upper portion. The internal chamber defined by this structure carries body **117*a* of weight 117 with its radially smaller neck portion 117*b* extending upwardly through the orifice defined by annular top 116 and into the lower portion of body channel 105**.

Cylindrical fastening neck 118 is structurally carried by the upper surface of annular top 116 to extend a spaced distance upwardly therefrom at a position radially outwardly from the orifice defined by annular top 116. The configuration of the fastening neck 118 is such that its inner surface fits in the lower fastening cap groove 111 defined by body 104 and preferably when in this position, its outer surface will be substantially coextensive with the outer surface of body 104. The fastening neck 118 in its inner upper surface defines annular fastening groove 119 so positioned and configured as to receive the lower cap fastening rim 113 in a releasably fastenable fit by reason of the conformable and resilient nature of the elements involved. The axial length of weight 117 is limited by the position of septum 106 but otherwise its configuration may be varied according to the desired mass of the overall handling.

Figure 9:
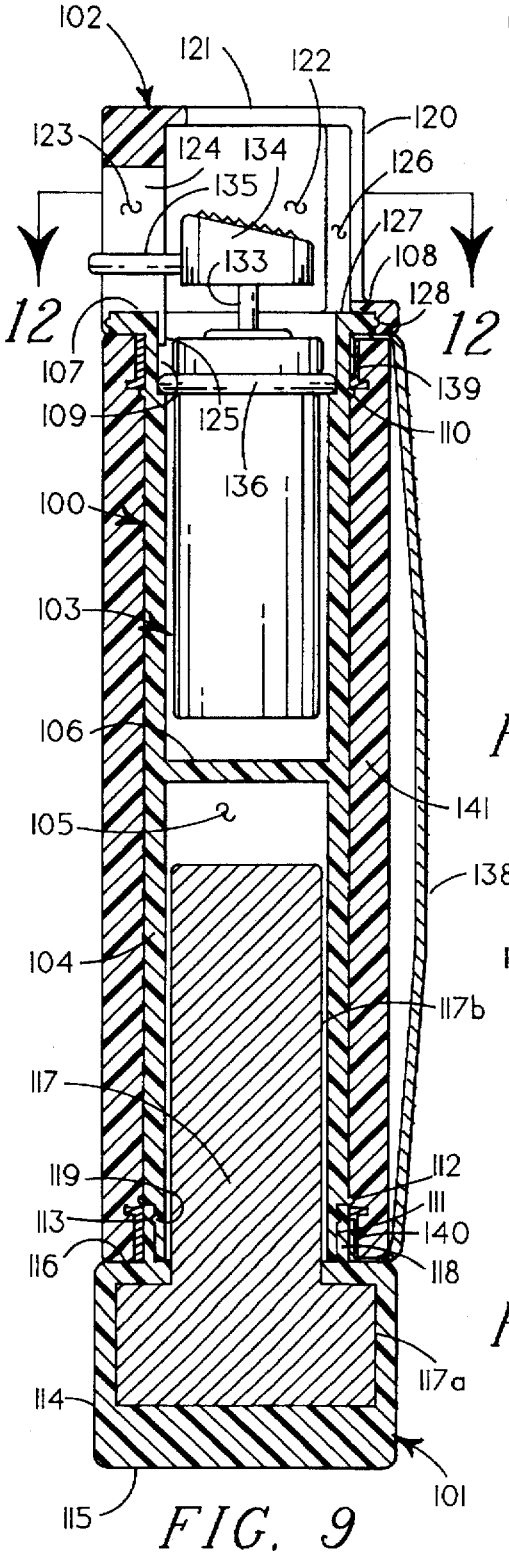
FIG. 9 is a medial vertical cross-sectional view through a second species of hand weight showing various of its parts, their configuration and relationship.
Figure 13:
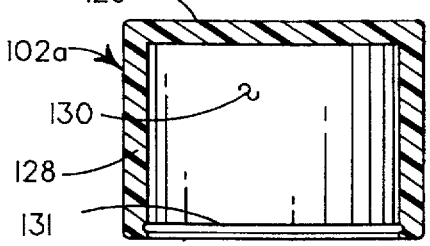
FIG. 13 is a medial vertical cross-sectional view through an upper end cap that may be used on a weight not having a self-defense spray container.

The upper cap 102 takes the form illustrated in FIG. 9 when used with a hand weight that is to carry a defense spray container and takes the form **102*a* illustrated in FIG. 13** when used with a hand weight without a defense spray container.

Upper cap 102, similarly to the cap 12 of the first species, is formed by circumferential skirt 120 carrying top 121 to define medial channel 122. The skirt 120 defines spray nozzle slot 123 extending spacedly upwardly from its lowermost edge and in the instance illustrated, having sides 124 extending a spaced distance radially inwardly beyond the inner surface of the body cylinder defining the spray container groove 109 to allow alignment dogs 125 to depend thereover to aid alignment of the cap on the body cylinder. The top 121 defines thumb slot 126 extending from a position diametrically opposed to the spray nozzle slot spacedly inwardly to allow access to the operating mechanism of a spray container carried within chamber 122. The thumb slot extends vertically downwardly in the skirt 120 to terminate at alignment shelf 127 which fits immediately above the upper edge of body cylinder 104 when the upper cap is positioned thereon. The lower inner surface of skirt 120 defines annular fastening groove 128 so configured and positioned as to fastenly engage annular fastening rim 108 defined by the body rim when the cap is positioned on the body.

The cap 102*a* of FIG. 13 is a similarly dimensioned and configured peripherally defined cylindrical structure formed by continuous circumferential skirt 128 and top 129 to define medial chamber 130. The lower inner surface of the skirt 128 defines annular fastening groove 131 to fastenably engage fastening rim 108 to releasably fasten the cap 102*a* on the upper end of the body 100.

Figure 10:
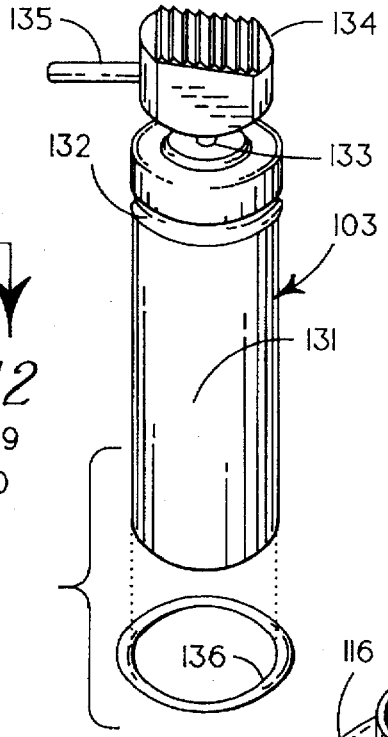
FIG. 10 is an expanded isometric surface view of the defense spray container shown in FIG. 9.
Figure 11:
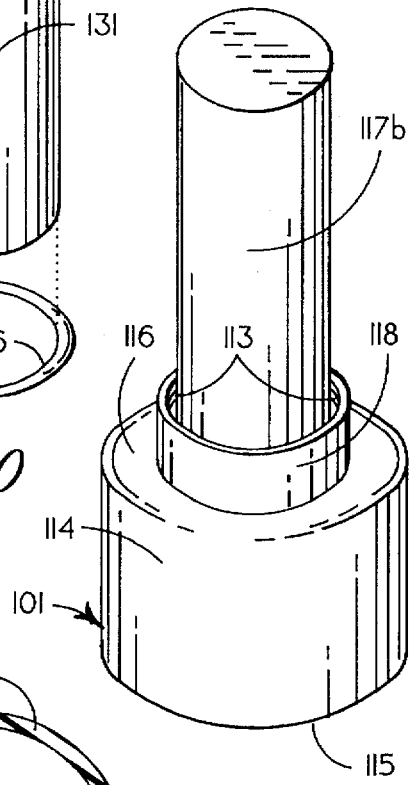
FIG. 11 is an isometric surface view of the lower weight carrying end cap of the hand weight of FIG. 9.
Figure 12:
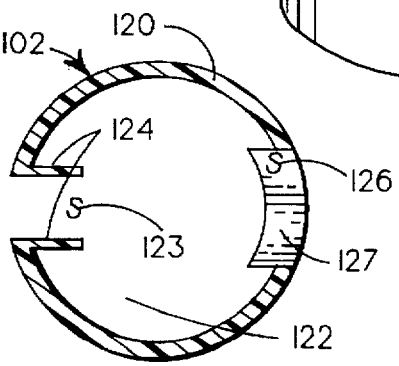
FIG. 12 is a horizontal cross-sectional view through the upper end cap shown in FIG. 9, taken on the line 12—12 thereon in the direction indicated by the arrows.

The spray container 103 illustrated in FIG. 10 for use with this second species of weight illustrated in FIG. 9 is somewhat different from the container used in the first species. This container 103 provides elongate cylindrical body 131 defining annular groove 132 spacedly below its top. The dispersement structure is similar to the container used with the first species in providing dispersement channel 133 supporting dispersement valve 134 spacedly above the container with nozzle 135 extending from the valve perpendicularly to the axis of the body. The spray cylinder body 131 is similar in configuration and incrementally smaller than body channel 105 so that the container will slidably fit therein. A resilient annular ring 136 is carried in groove 132 to extend in a radial direction spacedly outwardly from the body cylinder for carriage within spray container groove 109 to support the spray container in the body channel 105.

Having described the structure of my hand weights, their operation, which is substantially the same for either species of weight, may be understood.

A pair of weights are formed according to the foregoing specification, one of the pair having an upper removable end cap that does not provide for a defense spray container and the other having an upper removable end cap that does provide for containment of access to operative mechanism of an associated defense spray. To insert a defense spray container in the weight designed therefore, the upper end cap is removed by manual manipulation causing it to move axially from its releasably fastened position on the body cylinder upon appropriate deformation of the joined elements.

With the first species of weight, sleeve 13 is manually removed from the end portion of body channel 17 by inserting a finger in the medial channel 42 and beneath inwardly extending rim 41 so that the rim may be used to exert axial force upon the sleeve for removal. After the sleeve is removed, defense spray container 14 is inserted in an angulated orientation through container window 43 with its operating mechanism uppermost. The container is manipulated to move the operating mechanism upwardly through the orifice 42 defined in the upper end of the sleeve so that the lower portion of container 55 may be moved into chamber 43 where it is biased against inner rim 41 by resilient tab 44. The sleeve containing the defense spray container is then replaced in the open upper end of channel 17 and end cap 12 is replaced in a position which allows dispersement nozzle 59 of the defense spray container to project through the upper portion of nozzle slot 36 defined in the end cap. In this positions operating trigger 58 will be accessible laterally and from above through thumb slot 33.

The spray container of the second species is prepared for use by moving annular ring 136 into position in groove 132. The container is then inserted bottom first in the upper orifice of the body cylinder and moved downwardly until the annular ring 136 is supported on the bottom of the spray container groove 109. The radial orientation is then adjusted for proper positioning of the spray container.

The upper end cap is then replaced on the upper end of the weight body. If the weight is to be stored rather than immediately used, the cover cap may be placed over the upper end cap to protect the defense spray mechanism and prevent accidental operation thereof.

For use in walkings jogging or running, normally only one hand weight having a self-defense spray container will be used and the other hand weight of a pair will not contain a spray container. The hand weight having a spray container commonly will have the cover cap removed before use, as if the spray is required for use, a user may be encumbered or delayed by having to remove the cover cap as a condition precedent thereto. Each of a pair of hand weights are grasped by the hands of a user by placing the fingers of the hand beneath the fastening strap and extending the finger about the periphery of the body covering so that fastening strap extends across the backs of the fingers or back of the hand. As this hand positioning is accomplished, the fastening strap will be placed under some elongate elastic tension and this tension will tend to positionally maintain the fastening strap and thusly the hand weight on the back of a user's hand. Both weights then may be used in a traditional fashion by an exercisers.

For use the hand weight carrying the defense spray container normally will be carried in the hand of major dexterity of the user. To disperse spray it is merely necessary to extend the thumb or a finger of a hand properly placed on the weight into the thumb slot and depress the operating trigger while pointing the dispersement nozzle at the desired target for the spray. The defense spray will then be dispersed to accomplish its normal functions upon that target. The dispersement of the spray may be rapidly accomplished after determination is made that it is to be used.

The foregoing description of my invention is necessarily of a detailed nature so that specific embodiments of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. In a hand weight with self-defense spray container having dispersement mechanism, the invention comprising, in combination:

an elongate cylindrical body having first and second ends and defining a medial body channel extending therethrough to create orifices in the said ends, with at least the first end of the said body defining external fastening means and inwardly adjacent internal fastening means;

a first end cap defining an internal cavity with an orifice configured to receive an end portion of the first end of the body, with fastening means to releasably engage the external fastening means of the body for positional maintenance on the first end of the body;

a self-defense spray container carried in the body channel inwardly adjacent the first end of the body with dispersement mechanism projecting outwardly from the body channel and into the cavity defined in the first end cap, said container having fastening means to releasably engage the internal fastening means of the body;

a second end cap carried by the second end of the body to enclose the body channel orifice in the second end of the body; and a flexible, cloth-like elastomeric fastening strap extending over the body from interconnection therewith immediately inwardly adjacent each end of the body.

2. The hand weight of claim 1 wherein:

the second end cap is releasably carried by the second end of the body and carries an elongate weight extending therefrom and into the adjacent portion of the body channel.

3. The hand weight of claim 1 wherein:

the second end cap is fixedly carried by the second end of the body and has a weight contained therein, and a removable weight is carried in the body channel between the defense spray container and the second end cap.

4. A hand weight with a self-defense spray container, comprising in combination:

an elongate, cylindrical body having first and second ends and defining a medial channel extending therethrough to create orifices in said ends, the first end of said body defining external fastening means and spacedly inwardly adjacent internal fastening means and a resiliently deformable cover covering the body;

a fixed cylindrical end cap structurally carried at the second end of the body to cover the body channel, said fixed end cap having a weight mass embodied therein;

a removable cylindrical end cap defining an internal cavity configured to receive an end portion of the first end of the body, with fastening means to releasably engage the external fastening means of the body for positional maintenance on the first end of the body, said end cap having a thumb slot extending radially inwardly from the cylinder wall of the cap and vertically downwardly from its top to communicate with the cavity defined therein and a vertically elongate nozzle slot extending through the cylinder wall of the cap diametrically opposite the thumb slot;

a cylindrical sleeve releasably carried in the first end portion of body channel, said sleeve having fastening means to engage the internal fastening means of the body a bottom with biasing means to bias objects adjacent thereto away from the sleeve bottom a window in its cylindrical side wall for insertion of a defense spray container, and a radially inwardly extending rim about the upper orifice to maintain a defense spray container in the sleeve but allow operating mechanism to extend through the upper orifice of the sleeve;

a radially inwardly extending rim about the upper rim about the upper orifice to maintain a defense spray container in the sleeve but allow operating mechanism to extend through the upper orifice of the sleeve;

an elastic fastening strap extending over the body from interconnection with the body inwardly adjacent each end cap.

5. A hand weight for exercisers having a pressurized defense spray container, comprising in combination:

an elongate cylindrical body having first and second ends, with a medial channel extending therethrough to create orifices in the said ends, the first end of said body defining first external fastening means and second internal fastening means adjacent the first end;

a cylindrical fixed end cap diametrically larger than the body and structurally carried by the second end of the body, said fixed end cap being axially aligned with the body, covering the medial channel at the second end of the body, and carrying a weight;

a cylindrical removable end cap diametrically larger than the body and defining a medial chamber with an orifice in the inner end of the cap to receive the end portion of the first end of the body, said removable end cap having first internal fastening means to cooperate with the first external fastening means of the body to releasably fasten the removable end cap on the body and defining a thumb slot extending from the periphery to communicate with the medial cavity and a nozzle slot, diametrically opposed to the thumb slot, extending through the cylindrical wall of the cap;

a cylindrical sleeve having a body slidably carried in the first end of the body channel, said sleeve having:

fastening means to cooperate with the internal fastening means of the weight body for releasable fastening of the sleeve in the body channel, a bottom covering a first inner end of the sleeve and defining biasing means to bias objects away from both sides of the bottom, an inwardly extending rim at a second outer end of the sleeve to maintain a defense spray container in the sleeve channel, and an orifice defined in the sleeve body for insertion of a self-defense spray container in the sleeve channel;

a self-defense spray container carried in the sleeve chamber, with operative mechanism extending outwardly from the sleeve and into the cavity defined by the removable end cap;

a flexible resilient cover carried by the body between the end caps; and an elastomeric fastening strap extending over the body from fastenable engagement with the weight body immediately inwardly adjacent each end cap.

6. In a hand exercise weight, the invention comprising, in combination:

an elongate cylindrical body having first and second ends and defining a medial body channel, extending therethrough to create orifices in said ends, each end of said body defining means for releasable attachment;

a first cylindrical end cap releasably carried by said means for releasable attachment of the first end of the body, said first end cap having a diametrically smaller weight extending therefrom and into the channel of the body adjacent thereto;

a second cylindrical end cap releasably carried by said means for releasable attachment of the second end of the body, said second end cap defining a channel and orifices for access to the channel; and a defense spray container received in said channel of the body having dispersement mechanism extending upwardly therefrom and means for positional maintenance in the body channel of the defense spray container with dispersement mechanism extending from the body channel and into the channel defined by the second end cap.

7. The hand weight of claim 6 further including:

a resiliently deformable cover on the external surface of the body between the end caps, and a flexible, cloth-like elastomeric fastening strap extending in immediate adjacency over the cover from interconnection with the body immediately inwardly adjacent each body end.

* * * * *